US005317339A

United States Patent [19]

Braun et al.

[11] Patent Number: 5,317,339

[45] Date of Patent: May 31, 1994

[54] PRINTING MODULE FOR AN INK-PRINTING SYSTEM HAVING AN INK STORAGE CONTAINER WITH AN INTEGRATED INK-PRINTING HEAD

[75] Inventors: Hilarion Braun, Xenia, Ohio; Wolfgang Schullerus, Evenhausen; Harald Schulz, Berlin, both of Fed. Rep. of Germany

[73] Assignees: Siemens Aktiengesellschaft, Munich, Fed. Rep. of Germany; Eastman Kodak Company, Rochester, N.Y.

[21] Appl. No.: 847,056

[22] PCT Filed: Sep. 28, 1990

[86] PCT No.: PCT/EP90/01640

§ 371 Date: Jun. 3, 1992

§ 102(e) Date: Jun. 3, 1992

[87] PCT Pub. No.: WO91/04861

PCT Pub. Date: Apr. 18, 1991

[30] Foreign Application Priority Data

Oct. 3, 1989 [EP] European Pat. Off. ..... 89118348.5

[51] Int. Cl.[5] ..... B41J 2/175

[52] U.S. Cl. ..... 346/1.1; 29/890.1; 346/140 R

[58] Field of Search ..... 346/1.1, 140 R; 29/890.1; B41J 2/175

[56] References Cited

U.S. PATENT DOCUMENTS

| | | | |
|---|---|---|---|
| 3,967,286 | 6/1976 | Andersson et al. | 346/140 |
| 4,253,103 | 2/1981 | Heinzl et al. | 346/140 R |
| 4,436,439 | 3/1984 | Koto | 346/140 R X |
| 4,503,442 | 3/1985 | Barbero et al. | 346/140 |
| 4,540,717 | 9/1985 | Mahnke et al. | 521/52 |
| 4,734,717 | 3/1988 | Rayfield | 346/140 |
| 4,771,295 | 9/1988 | Baker et al. | 346/1.1 |
| 4,929,969 | 5/1990 | Morris | 346/140 R |
| 4,931,811 | 6/1990 | Cowger et al. | 346/140 R |
| 5,047,790 | 9/1991 | Cowger et al. | 346/140 R |

FOREIGN PATENT DOCUMENTS

| | | |
|---|---|---|
| 0261764 | 3/1988 | European Pat. Off. . |
| 2915457 | 10/1980 | Fed. Rep. of Germany . |
| 2915467 | 10/1980 | Fed. Rep. of Germany . |
| 3011769 | 10/1981 | Fed. Rep. of Germany . |
| 3642204 | 6/1987 | Fed. Rep. of Germany . |

*Primary Examiner*—Benjamin R. Fuller
*Assistant Examiner*—Alrick Bobb
*Attorney, Agent, or Firm*—Kenyon & Kenyon

[57] ABSTRACT

A printing module for an ink-printing system, interchangeably attached in a holder, consists of an ink storage container with an ink-printing head arranged on it. The ink storage container contains a housing with an assembly surface for an ink-printing head, as well as an ink collection region directly adjacent to the assembly surface. The ink collection region is covered over a large area with a filter element made from woven plastic fabric. Furthermore, a storage element made of a micro-channeled, ink absorbing and releasing material is arranged in the housing, which is in direct contact with the filter element over a large area.

22 Claims, 3 Drawing Sheets

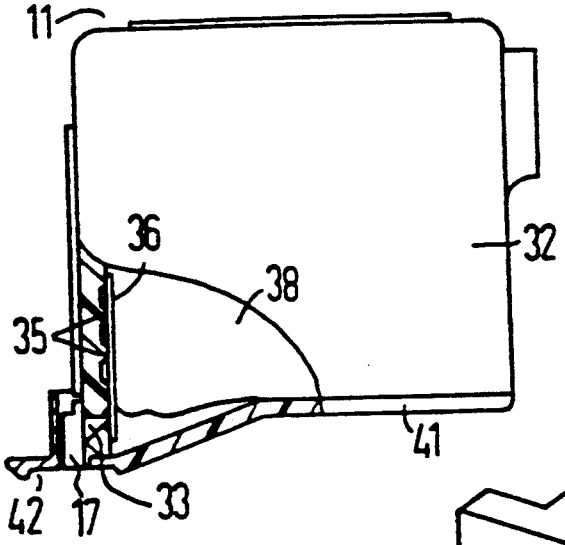
FIG 4
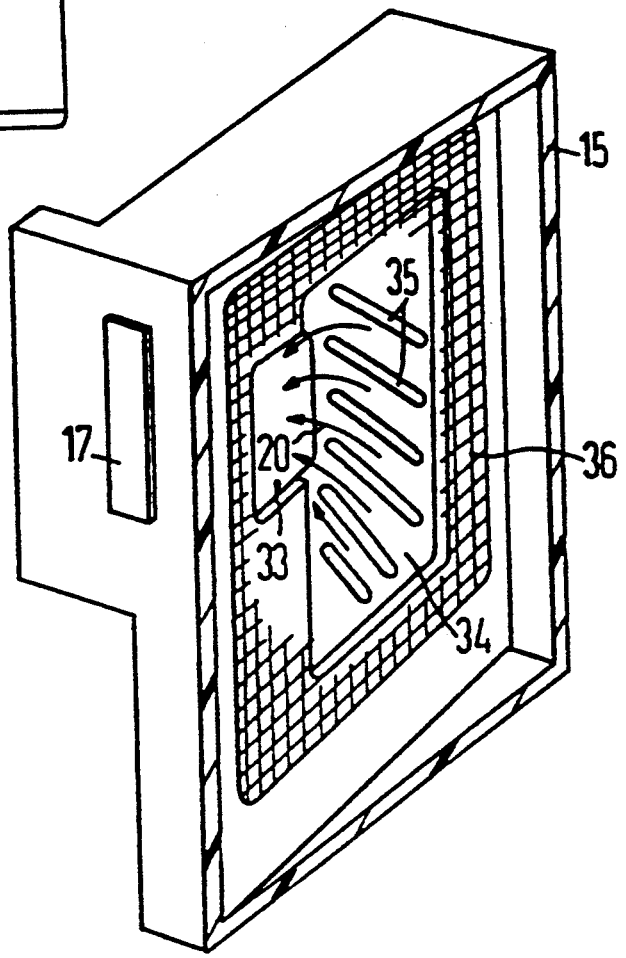
FIG 5
FIG 6
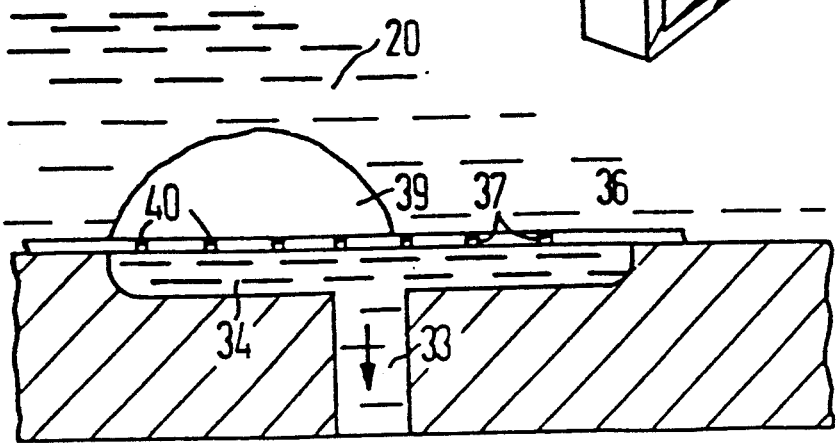

PRINTING MODULE FOR AN INK-PRINTING SYSTEM HAVING AN INK STORAGE CONTAINER WITH AN INTEGRATED INK-PRINTING HEAD

BACKGROUND OF THE INVENTION

The present invention relates generally to ink storage containers for ink-printing systems, and more particularly to an ink storage container for an ink printing system having an ink-printing head, which can be arranged on the ink storage container. The present invention also relates to a method for producing such an ink storage container.

Ink-printing systems with ink-printing heads that function according to piezoelectric or thermoelectric principles are generally known. In such ink-printing systems, an ink-printing head is moved along an image support, using an electric motor drive device. A print image is generated on the image support by character-dependent excitation of the ink-printing head. Ink is supplied to the ink-printing head from an ink storage container, which is either stationary or is moved along the image support together with the ink-printing head. In this way, the ink-printing head can form an interchangeable module with the ink storage container.

If the ink-printing head is moved together with the ink storage container in the form of a printing module, the capacity of the ink storage container is limited due to the drive forces required and limitations on the size. Care is necessary to ensure that in spite of great dynamic stress, the ink supply to the ink-printing head from the ink storage container is not interrupted. The ink storage container must also be structured so that complete utilization of the ink in the ink supply container is possible for an efficient printing operation.

U.S. Pat. No. 4,771,295 discloses an ink storage container with an integrated thermoelectric printing head. The ink storage container and the ink-printing head form a single structural unit in the form of a printing module, which is arranged on a printer carriage of the printing system. The entire housing of the ink storage container is filled with a porous material of polyurethane foam, which exhibits a controlled porosity. At the bottom of the ink storage container, an ink extraction opening in the form of a collar-shaped connection part that extends into the ink storage container is provided. This part is sealed off with regard to the porous material by means of a metal mesh grid. This serves to prevent penetration of air bubbles and dirt particles into the ink supply system. The porous material of polyurethane foam is pressed into the housing under pressure, so that a compression zone results in the immediate vicinity of the connection region. The pore size of this compression region is less than that in a region of the foam farther removed from the connection region. The aim of this measure is to increase the capillary forces in the area surrounding the connection region, so that ink can be reliably fed to the connection region.

The pipe-shaped connection region which projects into the container space reduces the ink supply that can be utilized. Furthermore, there is the risk that because of the small size of the connection region in comparison with the entire supply, the mesh grid will clog with air bubbles and therefore block the ink supply. Due to the foam compression, there is also the risk that singular regions with capillary behavior that deviate from one to the next will be formed. This could cause ink islands to form in the foam. Complete emptying of ink from the foam is therefore only possible within certain limits. Complete emptying furthermore presupposes that the foam is completely saturated with ink. Depletion zones have a detrimental effect on ink transport.

In the ink storage container disclosed in U.S. Pat. No. 4,771,295, the pipe-shaped ink collection region extends significantly into the housing. Therefore, part of the housing volume cannot be utilized to hold a storage element and therefore to store ink. Furthermore, the danger of ink clogging exists when the ink is extracted relatively rapidly.

Finally, the ink storage container disclosed in U.S. Pat. No. 4,771,295 requires defined compression of the storage element in the region of the filter element to guarantee targeted ink flow in the direction of the ink collection region. This can give rise to singular regions, each with a capillary behavior that differs from that of one or more of the others, which can lead to ink islands.

The present invention is directed to the problem of developing an ink storage container for an ink-printing system, in which the ink storage container has an ink-printing head assigned to it, which has a simple design avoiding the problems of the prior art, which allows as complete emptying of the ink as possible, and in which penetration of air bubbles into the ink supply system of the ink-printing head can be reliably prevented, without any interruption in the ink supply. The present invention is also directed to the problem of developing a method for producing such an ink storage container for an ink-printing system.

SUMMARY OF THE INVENTION

The present invention solves the problem of developing such an ink storage container by exclusively forming an ink collection region by a depression in the wall on the inside of the housing; by providing a limit area around the depression, which limit area is covered by a filter element and which limit area has longitudinal and lateral dimensions that are a multiple of the depth of the depression; by providing spacers in the depression to maintain a predetermined distance between the filter element and a bottom surface of the ink collection region; and by disposing the storage element essentially compression-free in the housing.

The present invention solves the problem of developing a method for producing such an ink storage container by manufacturing the housing using a plastic injection molding process, in which an ink supply opening is provided for the ink-printing head and a depression is provided on the inside wall of the housing, where the longitudinal and lateral dimensions of the depression are a multiple of the depth of the depression, which serves exclusively as an ink collection region; covering the ink collection region with a filter element; and inserting into the housing a storage element made of a porous, ink absorbing and releasing material, in such a way that the storage element and the filter element are in direct contact but essentially without pressure, and the storage element is held in the housing essentially without compression.

Arranging a filter element with a large area, connected with the storage element, and combining this with an ink collection region located below the filter element, allows uninterrupted ink extraction even if the filter element is partially clogged by air bubbles or dirt. A large dirt capacity can be achieved in this way, so much so that special cleaning of the storage element before placing it into the ink storage container is unnecessary. Furthermore, since there is no supply element or anything similar which projects into the container, the container volume can be better utilized.

The storage element consists of melamine-formaldehyde foam (MF), and has no compression regions and therefore no local pore size variation due to targeted compression. This allows easy installation of the filter element in the ink storage container, with greater tolerances on the storage element.

The large-area filter element of plastic fabric that can be wetted by ink, in combination with the storage element, acts to block air bubbles which have penetrated, even if the storage element is only slightly saturated with ink. Therefore, large air bubbles can attach themselves to the filter element without disrupting the ink supply. In spite of this partial blockage of the filter element, continuous ink supply is guaranteed.

The filter element maintains its air blockage effect even if it projects partly out of the ink level in the foam, because a moisture-saturated climate prevails inside the ink storage container, preventing the filter from drying out.

To ensure a reliable ink supply, it is only necessary that parts of the filter element are connected with the storage element. In this way, it is possible to position the ink storage container in different positions. It is not necessary to arrange the ink extraction location at the lowest part of the ink storage container. When using an ink-printing head which can be arranged at any desired location on the ink storage container, e.g., also in the upper region of the ink storage container.

The ink collection region arranged below the filter element, with spacers to ensure a predetermined distance between the filter element and a bottom surface of the ink collection region, allows ink flow even if the storage element is pressed against the screen. Constriction of the ink supply opening is not possible.

The entire ink storage container can be very easily made using a plastic injection molding process, without observing exact tolerances. The cover which closes the ink storage container simultaneously serves as protection for the ink-printing head, i.e., as the sealing surface for a sealing cap arranged in the printer.

The arrangement of the ink-printing head and a contact plate on an assembly area on the outside of the ink storage container allows easy and reliable contacting of the printing module in a holder device of a printer carriage of the printing system.

Guide and positioning elements arranged in the holder device ensure reliable, clear and wear-free positioning even if the printing module is changed frequently.

Due to the design of the depression in the inside wall of the housing, almost the entire housing volume is available to hold the storage element and therefore to store ink in the ink storage container according to the present invention.

In the present invention, the filter element covers the entire limitation area of the ink collection region, i.e., the frontal side of the supply element. Furthermore, the longitudinal and lateral dimensions of the limit area of the depression covered by the filter element are a multiple of the depth of the depression. In this way, a relatively large area is made available for the ink to flow in from the storage element, with reference to the entire limitation area of the ink collection region, i.e., its total volume, so that even at great ink throughput, a relatively slow flow velocity can be maintained in the region of the filter element. This allows reliable continued flow of the ink even under extreme ink extraction conditions and with partially plugged or nonpermeable filter element segments.

The design of the ink storage container according to the present invention allows essentially compression-free insertion of the storage element in the housing, so that the difficulties basically connected with compression are avoided. The ink storage container according to the present invention therefore allows almost optimum utilization of the housing volume for ink storage, where uninterrupted ink extraction is guaranteed even with partial clogging of the filter element. All that is necessary for this is that parts of the filter element are connected with the storage element. A certain position or arrangement of the ink collection region is therefore not necessary.

BRIEF DESCRIPTION OF THE DRAWINGS

FIG. 4 depicts a partial cross-sectional view of the printing module from above.

FIG. 5 shows a representation of the principle of the ink supply region of the ink storage container.

FIG. 6 illustrates the principle of the air-blocking effect of the filter element.

DETAILED DESCRIPTION

Figure 1:
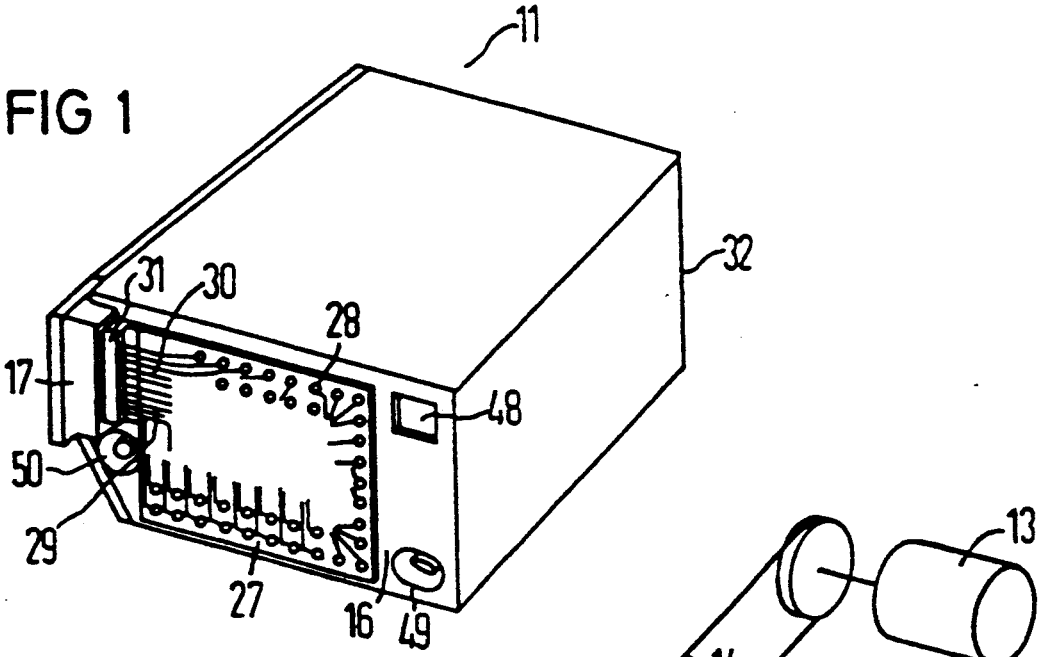
FIG. 1 depicts a schematic representation of a printing module consisting of an ink storage container with an ink-printing head arranged on it.
Figure 2:
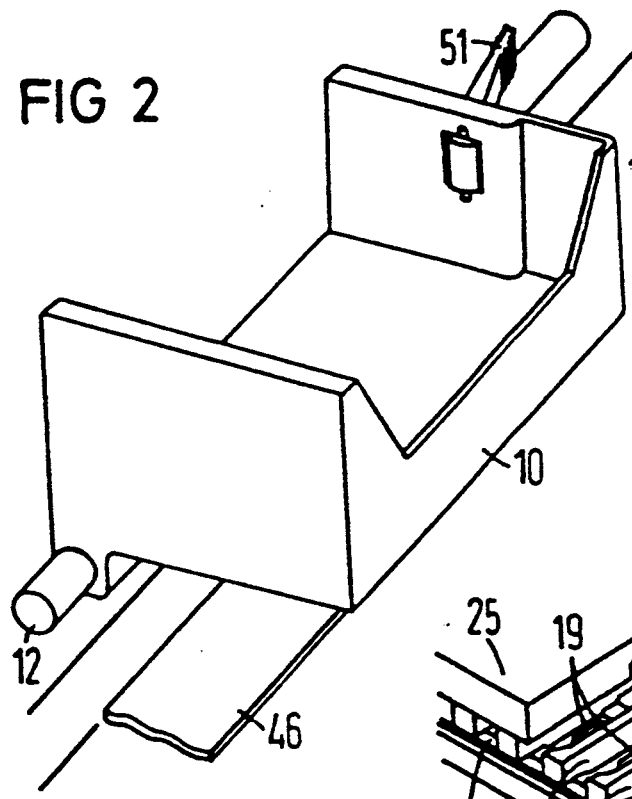
FIG. 2 shows a schematic representation of a holder of an ink-printing system, which holds the printing module.

An ink-printing system represented in FIGS. 1 and 2 contains a printer carriage 10 in the form of a holder to hold a printing module 11, which can be interchanged. The printer carriage 10 is guided on guide rods 12 and is moved back and forth on these guide rods 12 (only one of these rods 12 is shown) via an electric motor drive 13 and via cables 14, when in printing operation. The printing module itself consists of a housing 15 made of injection molded plastic, with an assembly surface 16 for an ink-printing head 17, which is structured as a so-called bubble jet ink-printing head—a printing head which works with heating elements as the drive elements. It is also possible, however, to use other types of ink-printing heads, e.g., ink-printing heads with piezoelectric drive elements.

Figure 3:
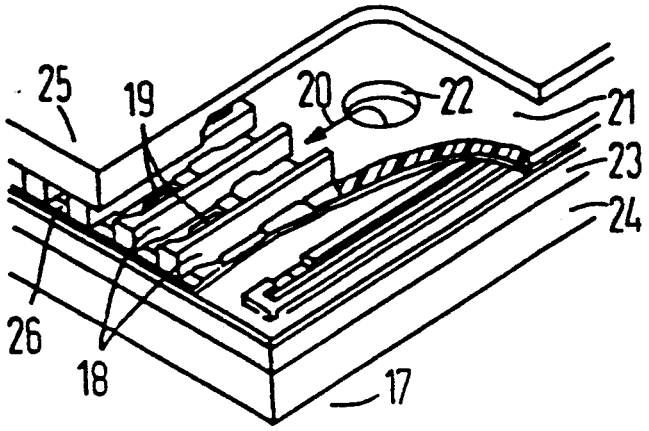
FIG. 3 illustrates a cross section of the ink-printing head.

The ink-printing head 17 used in the embodiment of the present invention functions according to thermoelectric principles, is structured in layers, as shown in FIG. 3, and has jet channels 18 with heating elements 19 arranged in them. Located in front of the jet channels in the transport direction of the ink 20, there is an ink chamber 21 with an approximately circular ink feed opening 22. The ink feed opening 22 leads through a silicon substrate layer with an underlying base layer 24 of aluminum, which carries the jet channels 18. This base layer 24, however, can also be eliminated, or it can consist of a different material. The ink chamber 21 and the jet channels 18 are covered by a cover layer 25 in the form of a cover plate. The ink-printing head 17 is attached to the assembly surface 16 of the housing 15 in such a way (see FIG. 1) that the jet channels 18 run parallel to the assembly surface 16. When the heating elements 19 are excited, a steam bubble occurs above the heating elements 19, in known manner, which ensures that the ink 20 is ejected in droplets via jet exit openings 26 of the jet channels 18. To connect the ink-printing head 17 to a character generator which is assigned to the ink-printing system, a contact plate 27 is attached to the assembly surface 16, e.g., by gluing, which has corresponding raised contact nipples 28 in accordance with the number of heating elements to be controlled—in this case 50 heating elements—(see FIGS. 1 and 8). The contact nipples 28 are connected with a connection region 30 via lines 29, where the contact plate 27 is structured as a printed circuit board. The ink-printing head 17 itself also has a connection region 31, in which all the connection lines 30 of the heating elements 19 end. The connection between the connection region 30 of the contact plate and the connection region 31 of the ink-printing head is formed, e.g., by bonding or other known connection techniques, or by a plug contact, for example.

As is evident from FIGS. 1 and 4, the printing module 11 consists in principle of an ink storage container 32 with an ink-printing head 17 arranged on it. The ink storage container itself again consists, according to the representation of FIG. 4, of the housing 15 with the assembly surface 16, where the assembly surface 16 has an ink supply opening 33, which acts together with the ink feed opening 22 of the ink-printing head 17, as is evident from the detailed representation of the bottom region of the ink storage container in FIGS. 5 and 6. Directly adjacent to the assembly surface 16, towards the inside, an ink collection region 34 is formed in the housing 15 of the ink storage container 32. It consists, in principle, of a depression at the bottom of the housing 15, with a plurality of spacer elements 35 in the form of ribs or small columns, and the ink supply opening 33, which is arranged in the depression. The ink collection region 34 with its spacer elements 35 is covered over a large area by a filter element 36 in the form of a plastic net of polyamide, with ink passage channels (i.e. pores) with a diameter of 3–35 μm and a filter thickness of about 0.1 mm. Instead of a woven plastic fabric, it is also possible to use a woven metal fabric or another structure which has ink passage channels of the corresponding pore width. The decisive factor for the selection of the material, however, is its wettability with the printing ink 20 used. The remaining space of the ink storage container 32 is filled with a storage element 38 made of a micro-channeled, ink absorbing and releasing material, e.g., melamine-formaldehyde foam (MF). Instead of melamine-formaldehyde foam (MF), the storage element can also be produced from other, e.g., fibrous material.

Melamine-formaldehyde foam has, however, proven to be an especially advantageous material. This involves a skeleton-like structure of three-dimensionally branched fibers. In contrast to conventional foam with partially broken chamber walls, such a skeleton fiber foam has a significantly greater useful volume. The thin, branched fibers form connected cavity structures with each other, where the fibers have a relatively great length/diameter ratio of about 10:1 or more. This results in a useful volume of up to 99% in the foam. The pore size, i.e., the size of the cavity structures, is about 50 μm to 175 μm, where the majority of the pores has a size of about 140 μm to 160 μm. Since furthermore the pore size of the smallest pores hardly goes below 75 μm, this results in a relatively constant pore size, so that the foam can be completely emptied of ink or filled with ink.

As far as the composition of the foam material is concerned, it must be of such a consistency that it can be wetted by the ink used, but does not swell under the influence of the ink nor does it absorb components of the ink. An advantageous material for this has proven to be a material which contains more than 80% melamine-formaldehyde condensate. An unmodified, temperature-adjusted melamine-formaldehyde condensate with three-dimensionally branched fibers, which form a type of woven material, where the fibers are connected with each other, with a length to width diameter ratio of approximately 10:1 or greater and with a fiber density on the order of 1.1 grams per milliliter or greater is particularly advantageous. Woven structures which are too short, i.e., in which the length diameter ratio is too low, can reduce the useful storage volume.

Melamine foam for use in ink containers can be melamine-formaldehyde condensates, which in addition to melamine also comprise up to 50%, preferably 20% other materials from the group of temperature-adjusted resins, and which contain other aldehydes in addition to formaldehyde.

The storage element 38 lies flat on the filter element 36, without any special pressure, and is in direct contact with it. Due to this direct contact, the ink 20 stored in the storage element 38 penetrates through the filter element 36 and fills the ink collection region 34 located underneath it. From there, it is passed on via the ink supply opening 33, to the ink feed opening 22 of the ink-printing head 17.

The filter element 36 has the task of holding back any air bubbles 39 located in the ink storage container, by capillary action of the ink passage channels 37 (see FIG. 6), so that air bubbles 39 cannot penetrate into the ink supply system of the ink-printing head. This could result in failure of the ink-printing head. The pore size of the ink passage channels 37 is designed in such a way that at the greatest pressure difference which occurs between the ink storage container 32 and the ink-printing head 17, e.g., due to different levels or due to the influence of a vacuum pump used to flush the printing head, no air can penetrate through the filter element 36. Since the pores or ink passage channels 37 communicate with the ink located in the ink collection region 34, menisci 40 which are convex downwards form at the limit surface between the air bubble 39 and the ink 20, due to capillary forces. These prevent penetration of air into the ink supply system 33 of the ink-printing head 17. Because of the large-area design of the ink collection region 34 in combination with the filter element 36 and the storage element 38, ink supply is ensured even if, as shown in FIG. 6, parts of the filter element 36 are blocked by a larger air bubble 39. The filter element 36 retains its air blockage effect even if it partially projects out of the ink 20, as shown in FIG. 4, for example, because a moisture-saturated climate prevails inside the ink storage container 32. The filter element is furthermore able to hold back dirt particles.

Figure 7:
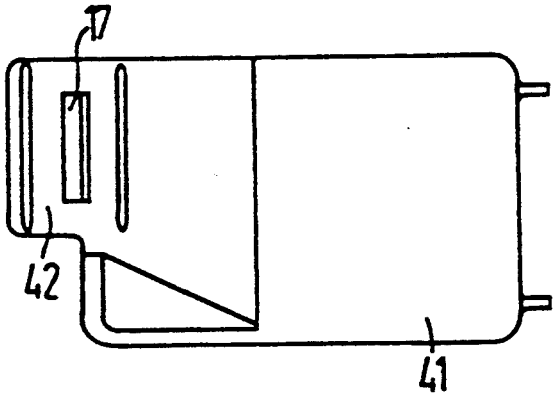
FIG. 7 depicts a frontal view of the printing module.

As FIG. 7 shows, the ink storage container 32 is covered by a housing lid 41, which has a region 42 which surrounds the ink-printing head 17, which region represents contact protection for the ink-printing head 17. It also acts as a spacer for the ink-printing head 17, in order to prevent the exit openings 26 of the ink-printing head 17 from coming into contact with the image support of the ink-printing system and thus becoming dirty, and it serves as a sealing surface for a sealing cap arranged in the printer, which closes off the exit openings during extended breaks in operation.

Figure 8:
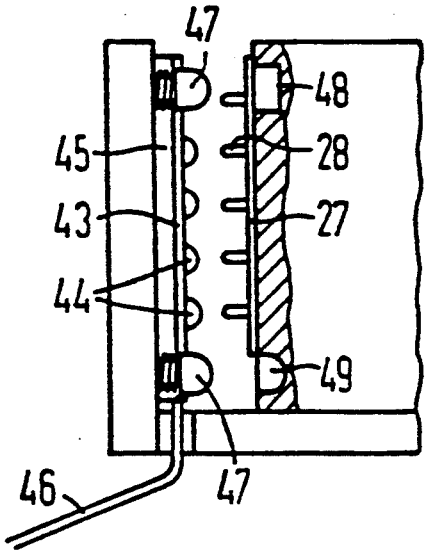
FIG. 8 shows a partial cross-sectional view of the contact region between the printing module and holder.

As initially explained in connection with FIGS. 1 and 2, the printing module 11 is interchangeably attached in the holder of the printer carriage 10. In order to be able to reliably carry out this attachment and contacting of the ink-printing head 17 with the control of the ink-printing system, counter-contact elements 44 are arranged in the holder 10, at a side surface, on a foil 43, as shown in FIG. 8. These counter-contact elements 44 consist of raised, gold-plated contact nipples, which are attached on the foil 43, where an elastic layer 45 consisting of elastomer is arranged between the foil 43 and the side surface of the holder 10, which ensures good contact due to its elasticity. The counter-contact elements 44 with the foil 43 are connected with a foil line 46.

Figure 9:
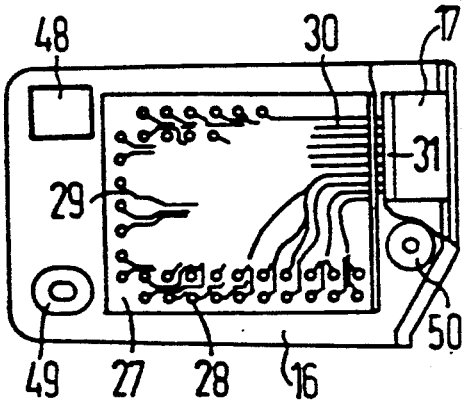
FIG. 9 illustrates a side view of the printing module.
Figure 10:
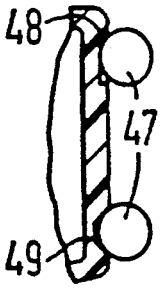
FIG. 10 shows a cross-sectional representation of the positioning elements of the printing module.

Furthermore, guide elements 47 are provided in the side surface of the holder 10 and at the printing module, for correct positioning of the printing module 11 in the holder. For this purpose, the printing module 11 according to FIG. 9 has three openings 48, 49, 50 at its assembly surface, into which the three sphere-shaped, e.g., guide elements 47, engage in the inserted condition of the printing module 11 in the holder 10 (FIG. 10). However, the guide elements can also be arranged rigidly, without springs. In accordance with the representation of FIG. 9, the upper opening 48 on the assembly surface 16 consists of a flat surface, arranged in a slight depression. A further centering opening 49 arranged below this opening 48 consists of a conical slit, and a centering opening 50 arranged approximately at the center, at the right edge of the assembly surface 16, has the shape of a cone. With the centering openings 48, 49, 50, in interaction with the sphere-shaped centering elements 47, the printing module 11 is locked in place and centered in the holder 10, with regard to all the degrees of freedom. To insert the printing module in the holder, the printing module 11 is first loosely inserted into the holder 10, and then a pressing force is exerted on a side surface of the printing module 11 via a clamping lever 51 (FIG. 2). With this, the printing module is centered over the centering openings 48, 49, 50, and the contact nipples 28 and the counter-contact elements 44 come into direct contact with each other, in the proper position. Furthermore, incorrect insertion of the printing module is prevented by the centering elements 47.

The printing module 11 is produced as follows: First, the housing 15 with the assembly surface 16 and the ink collection region 34 is manufactured using a plastic injection molding process. Then, the filter element 36, consisting of plastic, is inserted into the ink storage container 32, and bonded to the housing 15 at the edges. The storage element 38, separately made of melamine-formaldehyde foam, is then inserted into the housing 15, so far that the storage element 38 makes direct contact with the filter element 36. After placement of the contact plate 27 and attachment of the ink-printing head 17 on the assembly surface 16 of the housing 15, the housing 15 is covered with the lid 42. Finally, the storage element can be filled with ink, e.g., via a hollow needle.

In deviation from this production process, it is also possible, for example, to attach the ink-printing head 17 and the contact plate 27 on the assembly surface of the housing 15 immediately after production of the housing 15, and then to insert the storage element 38 introduced into the housing.

It is furthermore possible to produce the storage element 38 in the housing 15 itself, by foaming. After filling the ink storage container 32 with ink, it is necessary to remove the air located in the ink collection region and in the ink chamber 21 of the ink-printing head. For this purpose, the air is suctioned away via the jet openings of the jet channels 18, e.g., via a vacuum bell, so that the ink collection region and the jet channels, including the jet chambers, fill completely with ink. Once a closed, communicating fluid system has been established, the ink storage container, i.e. the in storage element 38 empties from above, specifically in the direction of the ink supply opening 33. This emptying is independent of the position of the ink-printing head. With the embodiment shown in FIG. 1, the ink-printing head is arranged in the upper region of the housing 15. This ensures that during the operating breaks of the ink-printing head, no ink runs out of the jet exit openings 26. Due to the capillary effect between ink and air at the jet exit openings 26, no air can penetrate into the jet channels via the jet exit openings 26. Vice versa, when the heating elements 19 are activated, the activity of the heating elements ensures that ink is fed to the ink supply opening 33 from the storage element, independent of the position of the ink supply opening 33. The only important factor is that the ink supply opening 33 is completely filled with ink. This is ensured by the ink collection region 34.

What is claimed is:

1. A printing module for an ink-printing system, comprising:

a) an ink storage container having an integrated ink-printing head;

b) a housing for holding said integrated ink-printing head, said housing having an ink supply opening and having an inner wall;

c) an ink collection region being disposed in said housing, and being in fluidic communication with said ink supply opening, wherein said ink collection region is formed exclusively by a depression in said inner wall of said housing, said depression being in a vicinity of a limit area of the ink collection region having longitudinal and lateral dimensions that are a multiple of a depth of said depression;

d) a filter element covering said limit area of said ink collection region and preventing penetration of air into said ink collection region;

e) a storage element being in direct contact with said filter element, being disposed essentially compression-free in said housing, and being made of a microchanneled, ink absorbing and releasing material; and f) a plurality of spacers being disposed in said depression, whereby said plurality of spacers maintain a predetermined distance between said filter element and a bottom surface of said ink collection region.

2. The printing module according to claim 1, wherein said housing further comprises an assembly surface for the ink-printing head.

3. The printing module according to claim 2, wherein said ink supply opening is disposed in said assembly surface, and said ink collection region is disposed directly adjacent to said assembly surface.

4. The printing module according to claim 1, further comprising a holder assigned to the ink-printing system, wherein said ink storage container is interchangeably attached in said holder.

5. The printing module according to claim 2, wherein said ink-printing head is rigidly attached on said assembly surface and said printing module can be interchangeably attached in the printing system.

6. The printing module according to claim 1, wherein said storage element further comprises foam containing melamine-formaldehyde, having a pore size between 50 μm–175 μm, and having a length/diameter ratio of fibers of 10:1 or greater.

7. The printing module according to claim 1, wherein said storage element comprises an ink wettable fiber material, said ink wettable fiber material having a length/diameter ratio of fibers of 10:1 or greater, and having a plurality of fibers forming a plurality of pore structures with a pore size between 50 μm–175 μm.

8. The printing module according to claim 1, wherein said filter element further comprises an upper and a lower limit surface, and a plurality of ink passage channels having a diameter, whereby at a predetermined maximum pressure difference that occurs between said upper and lower limit surfaces no air penetrates through said filter element into said ink collection region.

9. The printing module according to claim 1, wherein said filter element comprises either a woven plastic fabric or a woven polyamide fabric.

10. The printing module according to claim 1, wherein said filter element further comprises a plurality of ink passage channels having a diameter between 3 μm and 35 μm.

11. The printing module according to claim 1, wherein said plurality of spacers comprise either a plurality of ribs or a plurality of webs.

12. The printing module according to claim 1, wherein said ink-printing head comprises a thermoelectric ink-printing head having a plurality of jet channels containing a plurality of heating elements, and having an ink chamber located in front of said plurality of jet channels in an ink transport direction.

13. The printing module according to claim 1, further comprising a housing lid closing off said ink storage container, said housing lid having a region surrounding the ink-printing head, which region serves as contact protection for the ink-printing head.

14. The printing module according to claim 12, wherein said ink chamber further comprises an approximately circular ink feed opening being in fluidic communication with said ink supply opening.

15. The printing module according to claim 12, wherein said ink feed opening feeds ink to said ink chamber approximately perpendicular to a progression of said plurality of jet channels.

16. The printing module according to claim 1, further comprising a housing surface having a contact plate with a plurality of contact elements, wherein said ink-printing head further comprises a plurality of connections being coupled with said contact plate, said plurality of contact elements interacting with a plurality of corresponding counter-contact elements of a holder for holding the ink storage container.

17. The printing module according to claim 16, wherein said plurality of counter-contact elements and said plurality of contact elements are elastically arranged.

18. The printing module according to claim 4, wherein said holder further comprises a plurality of guide elements and a plurality of contact elements, whereby, when said ink storage container is placed into said holder, a guided contact connection occurs between said plurality of contact elements and said ink storage container.

19. The printing module according to claim 4, wherein said holder further comprises a clamping device locking said ink storage container in place in said holder.

20. A method for producing a printing module for an ink-printing system, comprising the steps of:

a) manufacturing a housing using a plastic injection molding process, wherein said housing has an ink supply opening for an ink-printing head of the ink-printing system, a depression disposed on an inner wall of said housing, a longitudinal and a lateral dimension of said depression being a multiple of a depth of said depression, and said depression serving exclusively as an ink collection region;

b) covering the ink collection region with a filter element; and c) inserting a storage element made of a porous, ink absorbing and releasing material, into the housing, whereby the storage element and the filter element are in direct contact but essentially without pressure, and the storage element is held in the housing essentially without compression.

21. The method according to claim 20, further comprising the steps of first producing the storage element separately, and then introducing said storage element into the housing.

22. The method according to claim 20, further comprising the step of producing the storage element in the housing by foaming.

* * * * *